US006497402B2

(12) United States Patent
Tharp

(10) Patent No.: US 6,497,402 B2
(45) Date of Patent: Dec. 24, 2002

(54) DIFFUSER MOUNTING SYSTEM FOR AERATION OF LIQUIDS

(75) Inventor: Charles E. Tharp, Columbia, MO (US)

(73) Assignee: Environmental Dynamics, Inc., Columbia, MO (US)

( * ) Notice: Subject to any disclaimer, the term of this patent is extended or adjusted under 35 U.S.C. 154(b) by 0 days.

(21) Appl. No.: 09/822,574

(22) Filed: Mar. 30, 2001

(65) Prior Publication Data

US 2002/0140116 A1 Oct. 3, 2002

(51) Int. Cl.[7] ..... B01F 3/04

(52) U.S. Cl. ..... 261/122.1; 261/122.2; 285/197

(58) Field of Search ..... 261/121.1, 122.1, 261/122.2, 124, DIG. 70; 285/197; 210/220

(56) References Cited

U.S. PATENT DOCUMENTS 3,953,553 A * 4/1976 Thayer ..... 261/122.1
4,273,364 A * 6/1981 De Lange ..... 285/197
4,960,546 A 10/1990 Tharp
5,032,325 A * 7/1991 Tharp ..... 261/124
5,059,358 A * 10/1991 Tharp ..... 261/122.2
5,673,481 A * 10/1997 Roberts et al. ..... 261/122.1
5,676,890 A * 10/1997 Ott ..... 261/122.2
5,714,062 A * 2/1998 Winkler et al. ..... 261/122.1
5,788,847 A * 8/1998 Tharp ..... 210/220
5,846,412 A * 12/1998 Tharp ..... 261/122.2

FOREIGN PATENT DOCUMENTS

DE 40 33 384 A1 * 4/1992

* cited by examiner

*Primary Examiner*—C. Scott Bushey
(74) *Attorney, Agent, or Firm*—Shook, Hardy & Bacon L.L.P.

(57) ABSTRACT

A diffuser mounting assembly includes two saddle sections having integral outlet fittings to which elongated air diffusers can be mounted for aerating liquid in a basin. Air laterals installed in the basin receive the saddle sections on opposite sides so that the outlet fittings and diffusers extending on opposite sides of the laterals. Wedge fasteners are applied to flanges on the top and bottom edges of the saddle sections to secure them on the laterals. The outlet fittings are offset below center on the saddle sections so that both the laterals and diffusers can be located adjacent to the floor. The diffusers with a saddle section attached to each can be shipped in a compact configuration in shipping cartons.

20 Claims, 2 Drawing Sheets

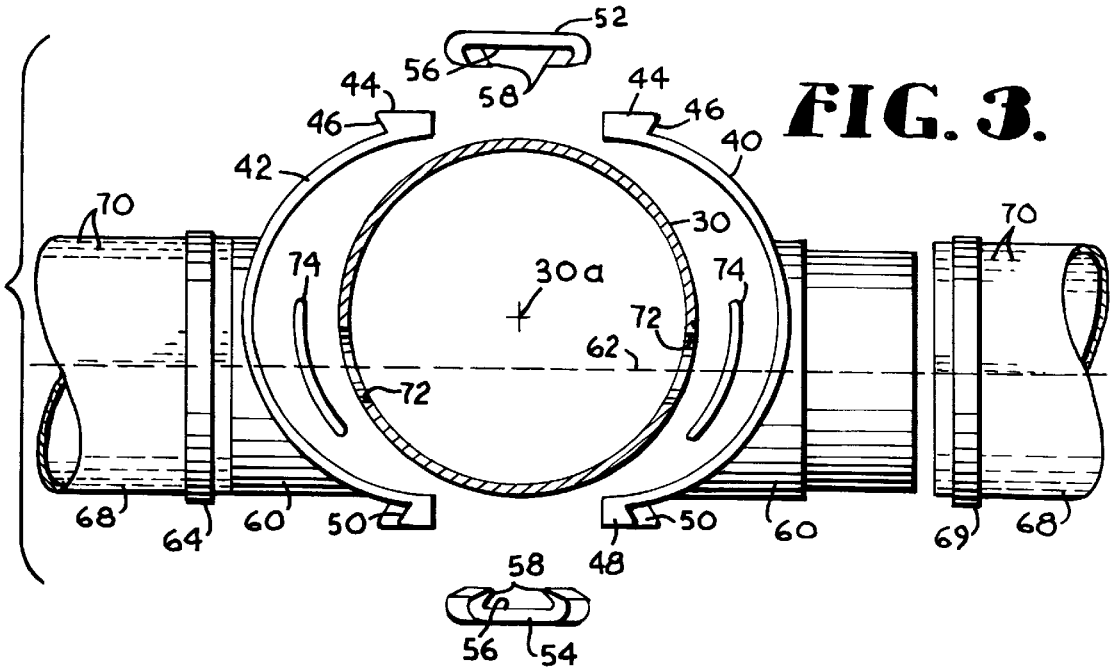
FIG. 3.
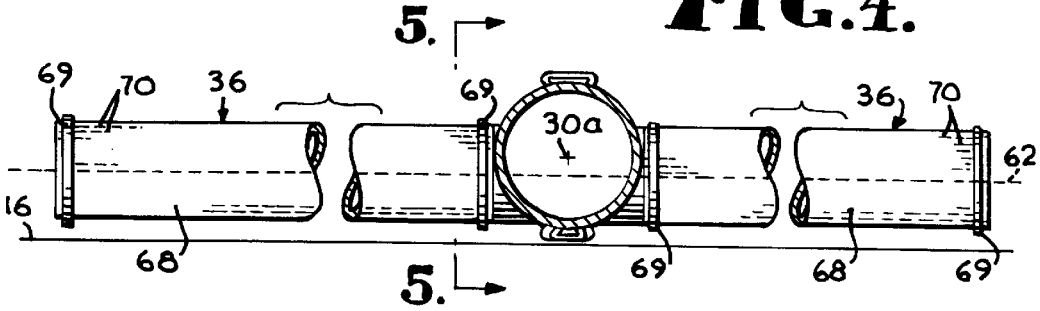
FIG. 4.
FIG. 5.
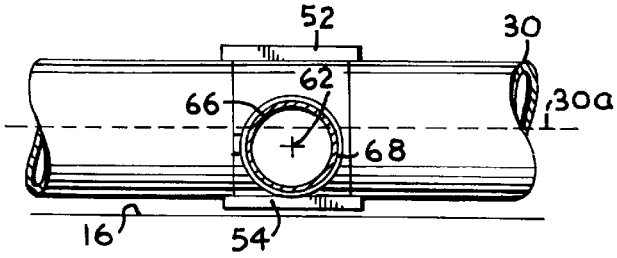
FIG. 6.
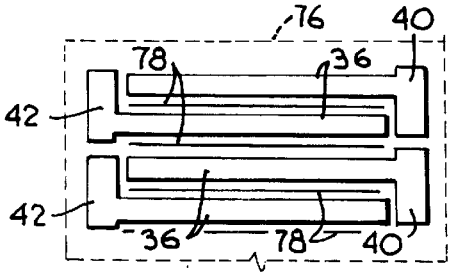

DIFFUSER MOUNTING SYSTEM FOR AERATION OF LIQUIDS

FIELD OF THE INVENTION

This invention relates in general to the aeration of liquids such as water and waste water and deals more particularly with an improved structure for mounting air diffusers on air supply piping.

BACKGROUND OF THE INVENTION

In the aeration of waste water and other liquids, it is common practice for air diffusers to be installed in the treatment basin which contains the liquid. Submerged air supply laterals receive air and apply it to diffusers which are connected with the laterals. The diffusers then discharge the air into the liquid in the form of bubbles. The highest efficiency aeration is achieved by using fine bubble diffusers such as porous membrane diffusers. However, less expensive coarse bubble diffusers are also used in some applications.

The diffusers can be connected to the supply piping in a variety of ways. When relatively long diffusers are used, as is becoming increasingly common in recent years, considerable leverage is applied by the diffusers. Consequently, the diffusers must be connected to the air laterals in a structurally sound manner in order to prevent breakage of the connection and other problems.

U.S. Pat. No. 4,960,546 to Charles E. Tharp discloses a diffuser mounting arrangement that has functioned well for the most part. The halves of a two piece saddle are fitted closely around the air lateral to provide a double wall thickness at the location where the diffuser connects with the lateral. This construction has proven to be strong enough to withstand the considerable forces that are applied by lengthy diffusers.

However, the patented system has not been ideal in all respects. A separate Tee fitting is needed, and this increases the component costs and also the labor costs due to the need to solvent weld the various parts together. Further, the diffusers are offset from the air lateral by the length of the Tee fitting. Therefore, the laterals must be spaced above the floor of the basin in order to accommodate diffusers that are mounted below the laterals, and this is a significant disadvantage in installations where it is desirable to locate the laterals as close to the floor as possible. Because both diffusers are connected to the Tee, the cantilever forces generated by both diffusers when the system is in operation are applied to the Tee and are concentrated at its connection with the saddle outlet spout. This concentration of forces at a potentially weak area of the system can create structural failure.

Perhaps even more importantly from a practical standpoint, it is necessary with the patented Tharp arrangement to connect both diffusers to the Tee fitting (and to one of the saddle sections) at the factory and then ship this assembly to the job site. The double diffuser assembly is an unduly long unit that includes two diffusers that may together be 3 meters long or more, together with the Tee fitting and saddle section. Long rigid crates are required for the packing of this assembly, thus adding significantly to the shipping costs. Moreover, the Tee fitting and saddle jut to one side at the center of the assembly and must fit in the crate, so there is a large volume of wasted space in each crate. The shipping costs are increasingly important when shipping distances are great such as in the case of overseas shipping.

U.S. Pat. No. 4,960,546 contemplates saddle units and Tee fittings that are standard commercially available products. Thus, each saddle and Tee assembly is useful with only a single pipe size used to form the diffuser body. Because there are different applications where different diffuser pipe sizes are necessary or desirable, the saddles and/or Tee fittings must be provided in different sizes. The inventory costs are increased accordingly.

SUMMARY OF THE INVENTION

The present invention is directed to a diffuser mounting assembly that is improved in a number of respects over the mounting arrangements that have been used in the past.

In particular, the diffuser mounting assembly of the present invention eliminates the need for a separate Tee fitting and the drawbacks associated with it. This is accomplished by providing specially constructed saddles that have integral outlet fittings to which the diffusers can be directly connected by solvent weld or otherwise. A number of important benefits are achieved by this construction.

First and perhaps most notably, the units can be packaged and shipped in two pieces, with each piece including one saddle section and one diffuser. The result is that the shipping carton is less than half as long as in the case of two diffusers and a Tee fitting all connected in line. The dramatic reduction in length allows cardboard cartons to be used instead of the rigid crates needed for longer units. This allows less expensive packaging products and decreases the time required to pack and load the units.

Elimination of the Tee fitting also allows the diffuser units to be placed side by side with the saddle sections overlapping the ends of the adjacent diffuser in alternating fashion. As a result of this, the space required to pack the diffusers is decreased by about 30% compared to units having Tees and saddles jutting out at the center of a double diffuser assembly. The shipping cartons can be provided with cardboard dividers between the diffusers so that the relatively fragile diffuser membranes are protected by cardboard on all sides. Standard designs and inventory can be used and can be quickly and inexpensively shipped.

Another feature of significance is the eccentric location of the outlet fittings on the saddle sections. The outlets are preferably located with their bottom surfaces at the same level as the bottom surface of the laterals. Accordingly, both the laterals and diffusers can be installed essentially on the basin floor. Maximizing the depth of both the laterals and diffusers is highly advantageous in many applications, as the air is released at the full basin depth to achieve maximum aeration.

The invention is further characterized by saddle outlet fittings that are specially constructed to closely receive one standard pipe size (for example, a 4 inch diameter pipe) on the outside and a smaller standard pipe size (for example, a 3 inch diameter pipe) on the inside. This allows one unit to accommodate two different diffuser body sizes and thus enhances its versatility and avoids the need to inventory different units for each different diffuser size.

Other and further objects of the invention, together with the features of novelty appurtenant thereto, will appear in the course of the following description.

BRIEF DESCRIPTION OF THE DRAWINGS

In the accompanying drawings which form a part of the specification and are to be read in conjunction therewith and in which like reference numerals are used to indicate like parts in the various views:

FIG. 3 is a sectional view through an air lateral showing the manner in which the diffuser mounting arrangement of FIG. 2 can be applied to mount a pair of flexible membrane diffusers to the air lateral;

FIG. 4 is a fragmentary sectional view on an enlarged scale taken generally along line 4—4 of the FIG. 1 in the direction of the arrows, with the break lines indicating continuous length of the air diffusers;

FIG. 5 is a fragmentary sectional view taken generally along line 5—5 of FIG. 4 in the direction of the arrows; and FIG. 6 is diagrammatic plan view showing the manner in which the diffuser mounting arrangement of the present invention allows the components to be packed in a compact manner for shipping.

DETAILED DESCRIPTION OF THE INVENTION

Figure 1:
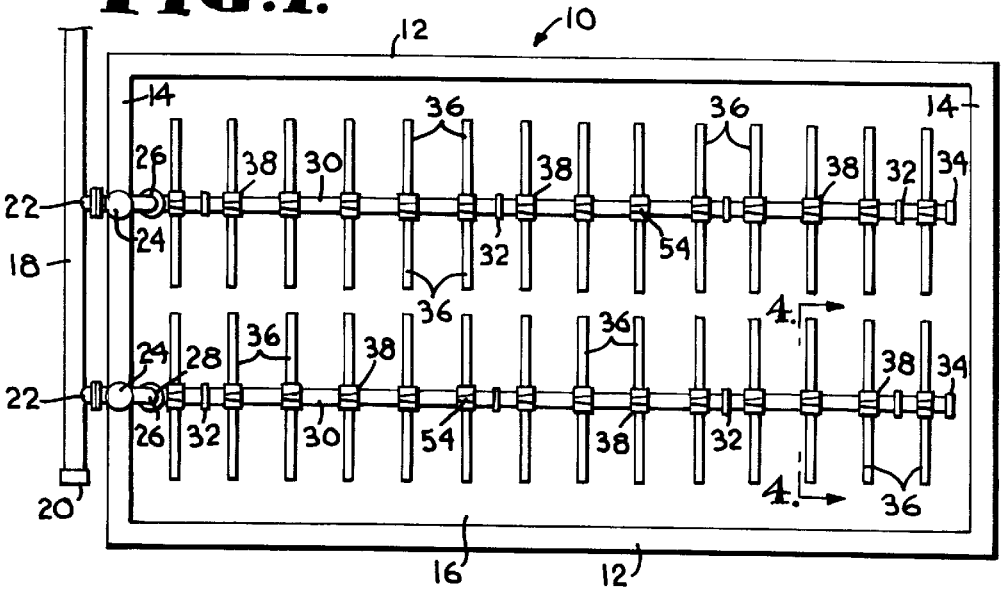
FIG. 1 is a diagrammatic top plan view showing a waste water treatment basin equipped with an aeration system having air diffusers connected with air laterals by a diffuser mounting arrangement constructed according to a preferred embodiment of the present invention.

Referring now to the drawings in more detail and initially to FIG. 1, the present invention relates in general to a system for aerating liquids such as water or waste water contained in a basin which is generally identified by numeral 10. The basin 10 may be a concrete structure having concrete end walls 12, side walls 14, and a floor 16. It should be understood that the present invention may be used in aeration systems that are installed in other types of basins, including earthen basins and tanks of various types, and to aerate liquids other than waste water.

In order to aerate the waste water that is contained in the basin 10, compressed air is supplied to a main header pipe 18 from a blower or compressor (not shown). The header pipe 18 is capped at 20 on one end. Connecting with and branching away from the header pipe 18 at spaced apart locations are a plurality of branch pipes 22. There are two of the branch pipes in the system shown in FIG. 1, although different numbers can be provided in different system sizes. Each branch pipe 22 connects with a valve 24. Connected with the opposite side of each valve 24 is an elbow 26 which provides a connection with a vertical drop pipe 28. The lower end of each of the drop pipes 28 is connected with one end of a horizontal air lateral 30. The air laterals 30 are parallel to one another and are preferably located near the floor as close to it as practical. The air laterals 30 may be connected with the concrete basin floor 16 by pipe supports 32. Each air lateral 30 is provided on its end with an end cap 34. Only two air laterals 30 are shown in FIG. 1 for simplicity, and virtually any desired numbers can be used depending upon the basin size.

The air laterals 30 are typically constructed of polyvinyl chloride but may be constructed of other suitable materials as well, including stainless steel, carbon steel, ABS or another plastic. Although locating the laterals 30 as close to the floor 16 as possible is preferable in most applications, the laterals need not always be adjacent to the floor and can in many systems be spaced above the floor.

In accordance with the present invention, a plurality of elongated air diffusers 36 are connected with each of the laterals 30 by special mounting saddles which are identified by numeral 38. The diffusers 36 may be virtually any type of diffuser having an elongated configuration, including coarse bubble diffusers, medium bubble diffusers and fine bubble diffusers. For highest efficiency, fine bubble diffusers are desirable, and they are typically porous membrane diffusers of the type that is known in the industry.

Figure 2:
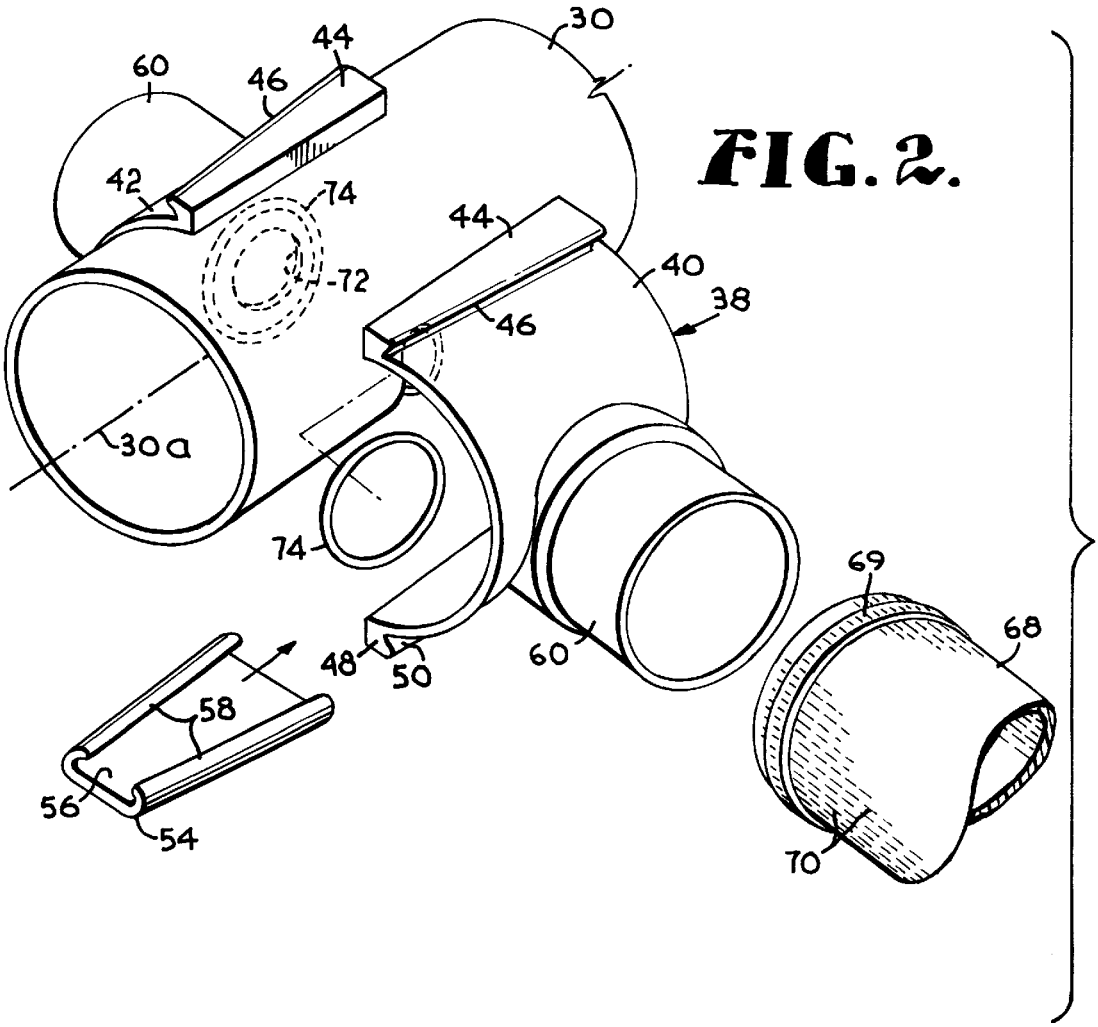
FIG. 2 is an exploded perspective view showing a diffuser mounting arrangement constructed according to a preferred embodiment of the present invention in conjunction with an air lateral to which the air diffusers can be mounted.

With particular reference to FIGS. 2 and 3, each of the mounting saddles 38 includes two complementary saddle sections 40 and 42. Each section 40 and 42 is substantially semi-cylindrical, and the sections 40 and 42 have a size and shape to cooperate to extend closely and completely around the cylindrical outside surface of the air lateral 30 to which they are applied. Each of the saddle sections 40 and 42 has an upper edge provided with a fastening flange 44. Each flange 44 has an angled lip 46. The lips 46 on the upper edges of the two saddle section 40 and 42 angle away from one another as they extend in a direction parallel to the longitudinal axis 30*a* (FIG. 2) of the air lateral 30 so that the flanges 44 present an increasingly greater width between the lips 46 from end to end.

The saddle sections 40 and 42 each has a lower edge that is provided with a similar flange 48. The lower flanges 48 have angled lips 50 that angle in a manner similar to the lips 46. Consequently, the flanges 48 provide an increasing distance between the lips 50 as they extend parallel to the air lateral axis 30*a*.

The saddle sections 40 and 42 are secured on the air lateral 30 by applying a special wedge fastener 52 (FIG. 3) to the upper flanges 44 and an identical wedge fastener 54 to the lower flanges 48. As best shown in FIG. 2, each wedge fastener is wider at one end than at the other end and gradually tapers from end to end. Each fastener 52 and 54 is generally c-shaped in section and presents a channel 56 which is bounded at the top by spaced apart hooks 58 which project inwardly from the fastener body. The channel 56 tapers from end to end, and the hooks 58 are progressively closer together from end to end due to the tapered configuration of the fastener.

Each of the saddle sections 40 and 42 is provided with an outlet fitting 60. The outlet fittings 60 project outwardly from the saddle section 40 or 42 and have a generally cylindrical shape. As best shown in FIG. 5, each of the outlet fittings 60 is located at an eccentric position on the saddle section 40 or 42. Each fitting 60 has a central axis 62 which is located closer to the lower edge that carries flange 48 than to the upper edge that carries flange 44. When the saddle 38 is assembled on the lateral 30, the central axes 62 of the opposing fittings 60 are in alignment with one another but are spaced below a position aligned with the longitudinal axis 38 of the air lateral 30. The lower surfaces of fittings 60 are at approximately the same elevation as the lower surface of the air lateral 30 on which the saddle sections are mounted.

An elongated fine bubble diffuser such as a porous membrane diffuser 36 is secured to each of the outlet fittings 60. Each diffuser 36 includes a rigid cylindrical pipe 66 (FIG. 5) which forms the body of the diffuser. Each of the pipes 66 is normally plugged internally at a selected location and is provided with a porous membrane 68 sleeved over and secured to the pipe 66 by pipe clamps 69. Each of the pipes 66 has ports for discharging air from within the pipe to the insole of the membrane 68. The membranes 68 have perforations 70 which open in response to air pressure supplied by the pipe 66 in order to discharge the air in fine bubbles to the liquid in the basin 10.

The outlet fittings 60 and the diffuser pipes 66 are preferably constructed of polyvinyl chloride, ABS, or another plastic material, and the pipes 66 are preferably solvent welded to the fittings 60. The fittings 60 are constructed so that one standard size of the diffuser pipes 66 can be fitted closely around and solvent welded to the fitting 60. Alternatively, a smaller standard size of the diffuser pipes 66 can be closely fitted inside of and solvent welded to the fitting 60. In this way, each of the fittings 60 can accommodate two different diffuser diameters. Therefore, each of the saddles 38 can be used with two different diffuser sizes so that the different sizes of the saddles 38 that needs to be maintained in inventory is reduced. Whether the diffuser pipe 66 is connected with the outside or inside of the outlet fitting 60, the diffuser 36 essentially forms an outward continuation of the fitting 60 and is coaxial with the fitting.

By way of example, the outlet fittings 60 can be constructed to receive a standard 4 inch diameter PVC pipe on the outside surface of the fitting and a standard 3 inch PVC pipe on the inside of the fitting. With these diffuser diameters, the diffusers are typically up to 1.5 meters long.

As best shown in FIGS. 2 and 3, the saddles 38 are applied to the air laterals 30 at locations where the laterals 30 are provided with outlet ports 72. The ports 72 are spaced along the length of each lateral 30 and are normally arranged in pairs located on opposite sides of the lateral 30. As shown in FIG. 3, the ports 72 are centered at locations below the midpoint of lateral 30 (which coincides with the level of the axis 30*a*) and are preferably centered at locations that coincide with the outlet port axes 62. An O-ring 74 or other seal ring is sandwiched between the outer surface of the air lateral 30 and the inner surface of the corresponding saddle section 40 or 42 to provide a seal around each port 72. The eccentric locations of the ports 72 on the laterals 30 results in efficient direction of the air into the outlet fittings 60 which are located closer to the lower edge than to the upper edge of the corresponding saddle section 40 or 42. In some instances, the diffusers may be arranged singly, and there is only a single part provided in that situation. Also, the diffusers can be mounted eccentrically above the air lateral axis 30*a* if desired.

Preferably, the diffusers 36 are connected with the saddle sections 40 and 42 at the factory and shipped to the site of the basin 10 for installation on the air laterals 30 there. The manner in which the construction of the present invention facilitates shipping of the diffuser assemblies is best shown in FIG. 6. A number of the diffuser assemblies can be packed side by side in a carton 76 which may be constructed of cardboard or another relatively inexpensive material. The diffuser 36 are located side by side with the saddle sections 40 and 42 alternating end to end so that the saddle sections overlap the ends of the adjacent diffuser 36 in the manner shown in FIG. 6. Planar dividers 78 which maybe constructed of cardboard or a similar material maybe placed between each pair of adjacent diffusers 64 in order to provide protection for the membranes 68.

By virtue of the construction of the present invention, the units can be packed in this manner in relatively short cartons 76. Compared to an assembly that requires shipping of the diffusers 36 in pairs that are connected end to end with a Tee fitting between them, each carton 76 is only about half as long as the more rigid crates that are required for shipping of the longer diffuser assemblies. Additionally, because the saddle sections 40 and 42 can be arranged to overlap with the ends of the adjacent diffusers 36, there is little wasted space within the carton 76. Finally, the diffuser membranes 68 are fully protected by the bottom and top of the carton 76 and by the dividers 78 on the sides of the diffusers.

The saddles 38 can be quickly and easily installed on the laterals 30 in the basin 10. The two saddle sections 40 and 42 are applied to the opposite sides of the lateral 30 after the ports 72 have been formed at the desired locations. The wedge fasteners 52 and 54 can then be applied to the flanges 44 on the top of the lateral and to the flanges 48 on the bottom of the lateral, respectively. Due to the tapered configurations of the lips 46 and 50 and the hooks 58, the fasteners 52 and 54 act to wedge the flanges more tightly together as the fasteners are progressively forced onto the flanges, with the hooks 58 interfitting with the lips 46 and 50 to secure the saddle sections 40 and 42 to the opposite sides of the lateral 30. The final application of the wedge fasteners may involve forcefully driving them onto the flanges 44 or 48 with a hammer or mallet in order to assure secure clamping of the saddle sections 40 and 42 on the lateral 30. Before the fasteners are fully secured on the flanges, the saddle sections 40 and 42 should be adjusted rotationally on the air lateral 30 to assure that the diffusers 36 projecting from opposite sides of the lateral are level.

The provision of adjustable connectors such as the wedge fasteners 52 and 54 at both the bottom and top of the unit is important in order to assure leveling of both diffusers. If the air lateral 30 is smaller or larger than standard, the diffusers may tilt upwardly or downwardly depending on whether the top or bottom fastener is applied and tightened first. If a fixed hinge or other fixed connection is used at the top or bottom, there is no way to level the diffusers in this situation. However, with adjustable fasteners at the top and bottom, the tension at both the top and bottom can be adjusted as necessary to level both diffusers. For example, if the lateral is unduly small and the top wedge is tightened first, the diffusers will likely tilt upwardly. To solve this problem, the top wedge can be backed off and the bottom wedge can be tightened to a position where the diffusers are level. Consequently, adjustment at both the top and bottom connection areas is required in order to obtain a level condition of the diffusers as is necessary for the aeration system to operate properly.

Bolted connections and other types of adjustable connections can be used in many applications in place of the wedge connections. When wedge fasteners are used, it is preferred that they exceed the length of the flanges 44 and 48. This assures that the wedges are sufficiently adjustable on the flanges to accommodate varying diameters of the air laterals 30. This also assists in preventing installing personnel from simply applying the wedges until their ends are flush with the ends of the flanges. Instead, the wedges can be applied until they are adequately tight without regard to their position on the flanges 44 and 48.

When the aeration system is thereafter operated, air is supplied from the pipe 18 to the laterals 30 and discharges from the laterals through the ports 72 into the outlet fittings 60 and the connected diffuser pipes 66. The air flows from the pipes 66 to the interior areas of the membranes 68 and is discharged through the membrane openings 70 into the liquid in the basin 10 in the form of fine bubbles that effect efficient aeration of the liquid.

If necessary, the saddle sections 40 and 42 can be detached from the air lateral by removing the fasteners 52 and 54. Replacement diffuser assemblies can then be installed on the lateral in the manner previously described.

The eccentric locations of the outlet fittings 60 on the saddle section 40 and 42 preferably locates the lower surfaces of the diffuser 36 at substantially the same level as the lower surfaces of the laterals 30, as shown in FIGS. 4 and 5. Consequently, both the laterals 30 and all of the diffusers 36 can be located substantially on the floor 16 of the basin 10. This is highly advantageous because the entire depth of the basin can then be aerated. However, in some applications the saddle sections can be oriented so that the fittings 60 are above the axis 30*a*, with the laterals located close to the floor 16.

Another advantage of the present invention is the integral formation of the outlet fittings 60 as parts of the saddle section 40 and 42. This avoids presenting an area of weakness or a concentration of the forces applied by both of the diffusers 36 at a single location as occurs in the case of a Tee fitting such as disclosed in U.S. Pat. No. 4,960,546 to Tharp. While each diffuser still provides a cantilever force, these forces are applied separately to the saddle sections 40 and 42 rather than to a single location as in the case of the Tee fitting. It is also noted that the saddle sections 40 and 42 cooperate with one another to extend closely and completely around the lateral 30 to provide what is essentially a double wall thickness of the lateral at the areas where the diffuser forces are applied, thus enhancing the structural strength of the entire piping system.

It is to be understood that the diffusers will in many cases be mounted such that they are centered above the axis 30*a* of the air lateral 30. Regardless of where the diffusers are located, the system of the present invention allows improved purging of water. Compared to a system where the connectors and diffusers are located on the bottom of the air laterals, the present system allows water that may enter the diffusers to readily flow from the diffusers to the supply piping, so a purge system can completely purge the water.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

Having thus described the invention, what is claimed is:

1. A diffuser assembly for application to an aeration pipe having a pair of air outlet ports in opposite sides thereof and adapted for immersion in liquid with a longitudinal axis of the pipe oriented generally horizontally, said assembly comprising:

a pair of saddle sections applicable to said pipe and adapted to be secured on the pipe to extend closely and substantially fully around the pipe;

an outlet fitting extending from each saddle section at a location to extend generally horizontally and to receive air from a respective one of said outlet ports when said sections are secured on the pipe;

a central axis of each outlet fitting, said axes being substantially aligned with one another and misaligned with said longitudinal axis of the pipe when said sections are secured thereon; and a pair of elongated tubular diffusers connected with the respective outlet fittings for discharging air to the liquid.

2. A diffuser assembly as set forth in claim 1, including a pair of wedge fasteners for securing said saddle sections on the pipe using wedging forces.

3. A diffuser assembly as set forth in claim 1, wherein said central axes of said outlet fittings are below the level of said longitudinal axis of the pipe.

4. A diffuser assembly as set forth in claim 1, wherein each diffuser includes a substantially cylindrical diffuser body having a solvent weld connection to the corresponding outlet fitting and a flexible membrane sleeved on said body for discharging air through said membrane into the liquid.

5. A diffuser assembly as set forth in claim 4, wherein a diffuser body is filled around the corresponding outlet fitting and connected thereto by a solvent weld connection.

6. A diffuser assembly as set forth in claim 4, wherein each diffuser body is filled into the corresponding outlet fitting and connected thereto by a solvent weld connection.

7. A diffuser assembly as set forth in claim 1, wherein each outlet fitting has an inside diameter to receive one standard plastic pipe size closely therein and an outside diameter to receive another larger standard plastic pipe size closely thereon to accommodate solvent weld connections to diffusers using either said one standard plastic pipe size or said other larger standard plastic pipe size.

8. A diffuser assembly as set forth in claim 1, wherein each of said saddle sections is substantially semi-cylindrical and includes opposite edges adjacent to corresponding opposite edges of the other saddle section when said sections are applied to said pipe, and including a pair of adjustable fasteners applicable to the opposite edges of said sections to secure the adjacent edges together and thereby secure said saddle sections on the pipe.

9. In an aeration system for liquid which includes a submerged air supply pipe extending substantially horizontally and having a longitudinal axis, the improvement comprising:

a pair of outlet ports in said supply pipe on opposite sides thereof for discharging air from the supply pipe;

a pair of saddle sections secured on said supply pipe, each saddle section having an outlet extending therefrom in a generally horizontal orientation to receive air from a respective one of said ports, said outlets being substantially in alignment and extending in opposite directions at locations offset from alignment with said axis of the supply pipe; and a pair of elongated tubular diffusers connected with the respective outlets and extending generally horizontally therefrom to receive air from the outlets and discharge the air into the liquid.

10. The improvement set forth in claim 9, wherein each of said saddle sections is substantially semi-cylindrical and cooperate to extend closely around substantially the entirety of said supply pipe.

11. The improvement set forth in claim 10, including:

upper and lower edges of each saddle section, said upper edges being located adjacent to each other on top of said supply pipe and said lower edges being located adjacent to each other on the bottom of said supply pipe; and upper and lower adjustable fasteners applied to the respective upper and lower edges of said saddle sections to receive said sections on said pipe.

12. The improvement of claim 11, wherein each of said fasteners applies a wedging force on the edges to which it is applied.

13. The improvement of claim 9, wherein each outlet has a substantially horizontal center axis, said center axes being aligned with each other and located below said longitudinal axis of the supply pipe.

14. Aeration apparatus for a system which includes an air supply pipe submerged in liquid to be aerated and having a longitudinal axis and a pair of outlet ports in opposite sides thereof, said apparatus comprising:

a pair of saddle sections secured on the pipe adjacent to said ports;

a pair of outlet fittings extending from the respective saddle sections in opposite directions at locations to receive air from the respective ports, said fittings being substantially aligned with each other and offset from alignment with said longitudinal axis of the supply pipe; and a pair of elongated diffusers connected with the respective outlet fittings and extending therefrom in substantially horizontal positions, said diffusers receiving air from said fittings and discharging air to the liquid.

15. Apparatus as set forth in claim 14, wherein:

said supply pipe has a lower surface; and each outlet fitting has a lower surface situated at substantially the same level as the lower surface of said supply pipe.

16. Apparatus for aerating liquid, comprising:

a plurality of air laterals submerged in the liquid adjacent to a bottom level thereof, each lateral receiving a supply of air and having a substantially horizontal longitudinal axis;

a plurality of outlet ports in each lateral, said ports being arranged in pairs on each lateral with the ports in each pair located on opposite sides of the lateral at locations offset below said longitudinal axis;

a diffuser mounting saddle for each pair of ports, each saddle including a pair of saddle sections secured together in a manner to extend closely around the corresponding lateral;

a pair of outlet fittings on each saddle extending in opposite directions from the respective saddle sections thereof at locations aligned with each other below a position centered on said longitudinal axis of the lateral; said fittings communicating with corresponding ports to receive air therefrom; and a pair of elongated diffusers connected with the respective fittings of each saddle to receive air therefrom and discharge the air to the liquid.

17. Apparatus as set forth in claim 16, wherein:

each of said saddle sections is substantially semi-cylindrical and includes an upper edge on top of the corresponding air lateral and a lower edge on the bottom of the corresponding air lateral; and each of said outlet fittings has a location closer to said lower edge than to said upper edge of the corresponding saddle section.

18. Apparatus as set forth in claim 17, wherein said upper edges of the sections of each saddle are adjacent and said lower edges of the sections of each saddle are adjacent, and including a pair of adjustable fasteners connecting the respective upper and lower edges together.

19. Apparatus as set forth in claim 18, wherein each fastener applies a wedging force to the edges to which it is applied.

20. Apparatus as set forth in claim 16, wherein:

each air lateral has a lower surface; and each outlet fitting has a lower surface situated at substantially the same level as the lower surface of the corresponding air lateral.

* * * * *